US012156575B2

(12) United States Patent
Rossier et al.

(10) Patent No.: US 12,156,575 B2
(45) Date of Patent: Dec. 3, 2024

(54) BRACELET CLASP

(71) Applicant: BLANCPAIN SA, Le Brassus (CH)

(72) Inventors: Nathan Rossier, Buix (CH); Xavier Nydegger, Cugy (CH)

(73) Assignee: BLANCPAIN SA, Le Brassus (CH)

( * ) Notice: Subject to any disclaimer, the term of this patent is extended or adjusted under 35 U.S.C. 154(b) by 51 days.

(21) Appl. No.: 18/092,725

(22) Filed: Jan. 3, 2023

(65) Prior Publication Data

US 2023/0320465 A1 Oct. 12, 2023

(30) Foreign Application Priority Data

Apr. 8, 2022 (EP) ..... 22167450

(51) Int. Cl.
*A44C 5/24* (2006.01)

(52) U.S. Cl.
CPC ..... *A44C 5/24* (2013.01)

(58) Field of Classification Search
CPC ..... G04B 37/1486; A44C 5/243; A44C 5/246; A44C 5/22; A44C 5/24
See application file for complete search history.

(56) References Cited

U.S. PATENT DOCUMENTS 8,789,246 B2 7/2014 Yliluoma et al.
9,993,051 B2 * 6/2018 Kaltenrieder ..... A44C 5/24
2012/0318018 A1 * 12/2012 Mouche ..... A44C 5/24 63/3.1
2013/0286797 A1 10/2013 Leger
2016/0270492 A1 * 9/2016 Kaltenrieder ..... A44C 5/14
2018/0343987 A1 * 12/2018 Queloz ..... A44C 5/147

FOREIGN PATENT DOCUMENTS

CH 700 356 B1 8/2010
CN 102613782 A 8/2012
EP 0 913 106 A1 5/1999

OTHER PUBLICATIONS

European Search Report for Application No. 22 16 7450 Aug. 25, 2022.

* cited by examiner

*Primary Examiner* — Jack W Lavinder
(74) *Attorney, Agent, or Firm* — Sughrue Mion, PLLC

(57) ABSTRACT

A bracelet clasp including a first rigid strip of which a first end is hinged on a first end of a second folding strip configured to receive a first strand of the bracelet at the second end thereof, and of which the second end of the first strip is hinged on a first end of a third folding strip from which first and second arms extend, and a cap hinged at one of the strips. The clasp is provided with first and second push-pieces. The clasp includes a banking which is housed between the first and second arms of the third strip in the closed position of the clasp, so as to ensure a symmetrical opening of the arms when simultaneous pressures are exerted on the push-pieces.

9 Claims, 3 Drawing Sheets

BRACELET CLASP

CROSS REFERENCE TO RELATED APPLICATIONS

This application claims priority to European Patent Application No. 22167450.0 filed Apr. 8, 2022, the entire contents of which are incorporated herein by reference.

TECHNICAL FIELD OF THE INVENTION

The invention relates to a bracelet clasp, and particularly to watch bracelets.

TECHNOLOGICAL BACKGROUND

From document CH 700 356, a clasp comprising two push-pieces which are integral with two hinged arms on flexible shafts is known. Such a clasp has the disadvantage that the flexible arms, due to machining tolerances, do not open symmetrically and the opening function is thus not always performed correctly.

From document EP 0 913 106, a folding clasp is also known, comprising a rigid base provided with two longitudinal members, a cap arranged to be attached to a strand of the bracelet, and at least one folding arm having a rear end attached to one end of the base by a first hinge and having a front end attached to the cap by a second hinge. The folding arm includes two juxtaposed arms provided with push-pieces, and wherein the front ends are separated by an elastic element. Such a clasp has the same drawback cited above, the cap having excessive play and not allowing a symmetrical opening of the flexible arms.

SUMMARY OF THE INVENTION

An aim of the present invention is that of remedying all or some of the drawbacks mentioned above by providing a clasp capable of fulfilling safety constraints while enabling a symmetrical opening thereof.

The aim of the invention is also that of providing a clasp of a design that is simple and economical to manufacture.

To this end, the invention relates to a bracelet clasp comprising:

- a first rigid strip of which a first end is hinged on a first end of a second folding strip configured to receive a first strand of the bracelet at the second end thereof, and of which the second end of the first strip is hinged on a first end of a third folding strip from which first and second arms extend of which the free ends are traversed by a shaft about which a cap is hinged equipped with first and second flaps extending perpendicularly with respect to the cap, and means for holding a second strand of the bracelet, the third strip partially covering the second end of the second strip when the clasp is in the closed position,
- first and second push-pieces integral with the first and second arms of the third strip,
- a locking mechanism arranged to keep the third strip locked on the first strip when no pressure is exerted simultaneously on the push-pieces.

According to the invention, the clasp comprises a banking housed between the first and second arms of the third strip when the clasp is in the closed position, so as to ensure a symmetrical opening of the arms when pressures are exerted on the push-pieces.

Thanks to these features, such a bracelet clasp makes it possible to limit the travel of each flexible arm and therefore ensure the function of the clasp by a symmetrical opening of the arms.

According to other advantageous alternative embodiments of the invention:

- the banking is rigidly connected to the second end of the second strip;
- the banking is rigidly connected to the first strip;
- the banking is rigidly connected to the cap;
- the banking has a width which defines the length of travel of the push-pieces;
- the clasp comprises locking means to keep the second strip locked against the first strip when the clasp is in the closed position, said means comprising hooks;
- the locking mechanism comprises, on one hand, a first pair of hooks rigidly connected to the first strip, and, on the other, a second pair of hooks rigidly connected to the third strip;
- the second pair of hooks is rigidly connected to the arms;
- the arms are laterally flexible on all or part of the length thereof.

The invention also relates to a wristwatch including a bracelet equipped with a clasp according to the invention.

BRIEF DESCRIPTION OF THE FIGURES

Further features and advantages of the invention will emerge more clearly on reading the following description of a particular embodiment of the invention, given merely by way of illustrative and non-limiting example, and the appended figures, wherein.

DETAILED DESCRIPTION OF THE INVENTION

A bracelet clasp will now be described hereinafter with reference jointly to FIGS. 1, 2, 3, 4 and 5.

Figure 1:
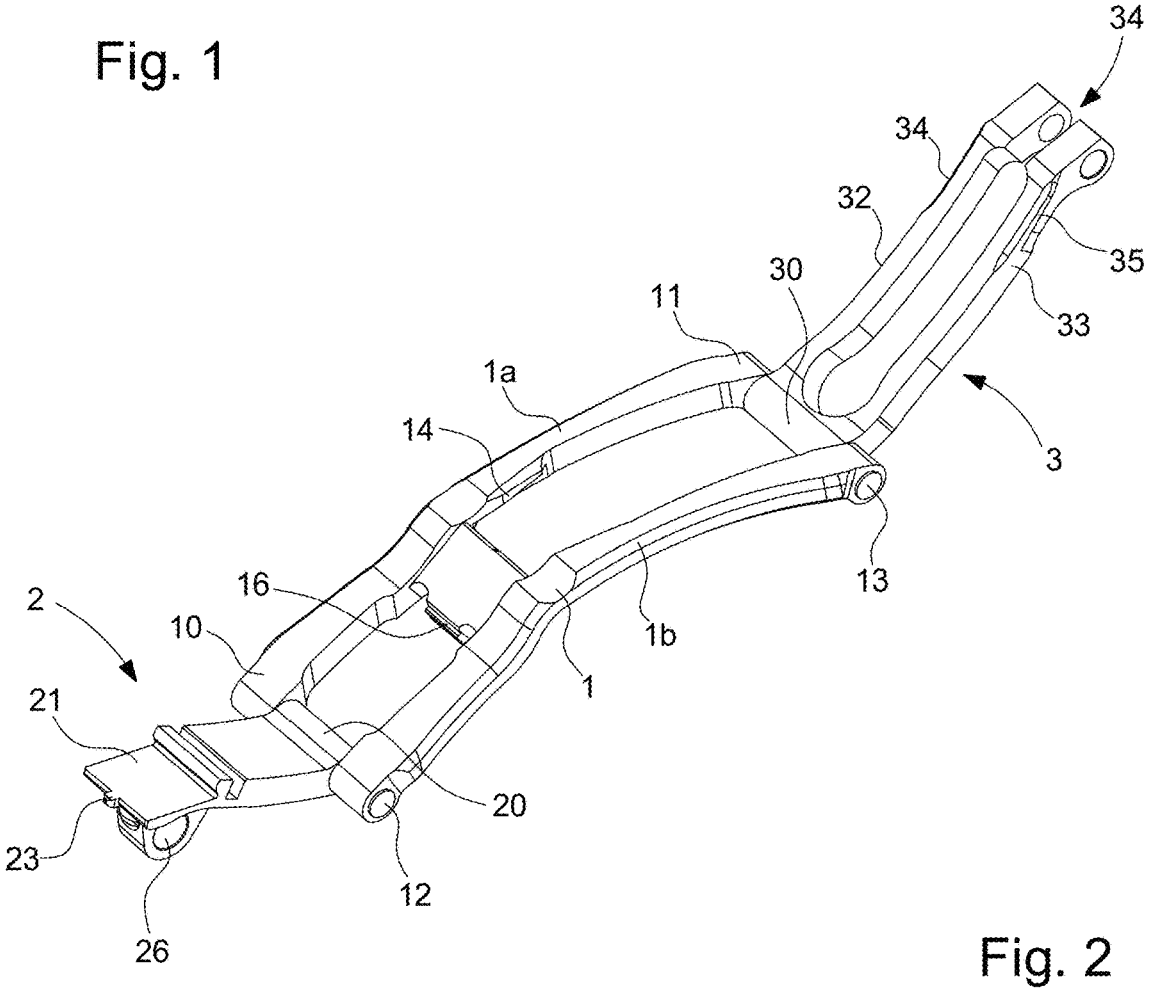
FIG. 1 is a perspective view of a clasp according to the invention, the clasp being in the open position.
Figure 4:
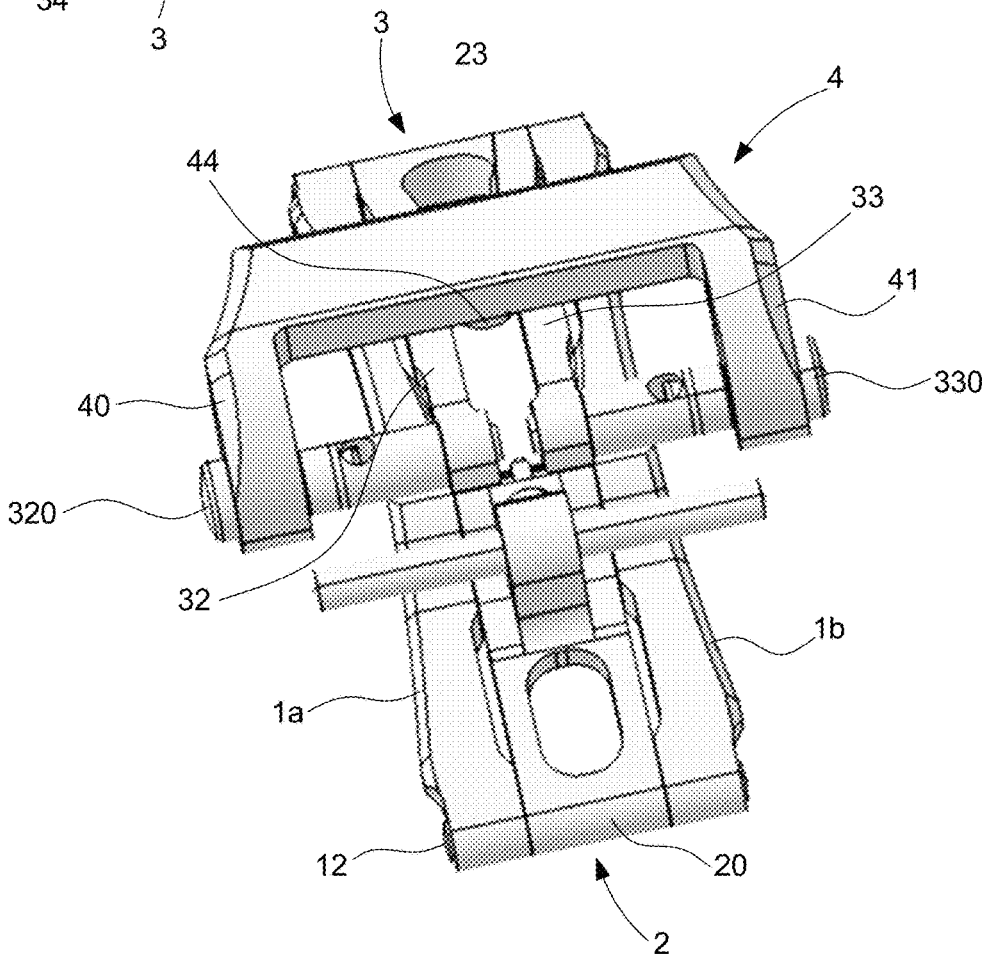
FIG. 4 is a perspective view of the clasp according to the invention.
Figure 5:
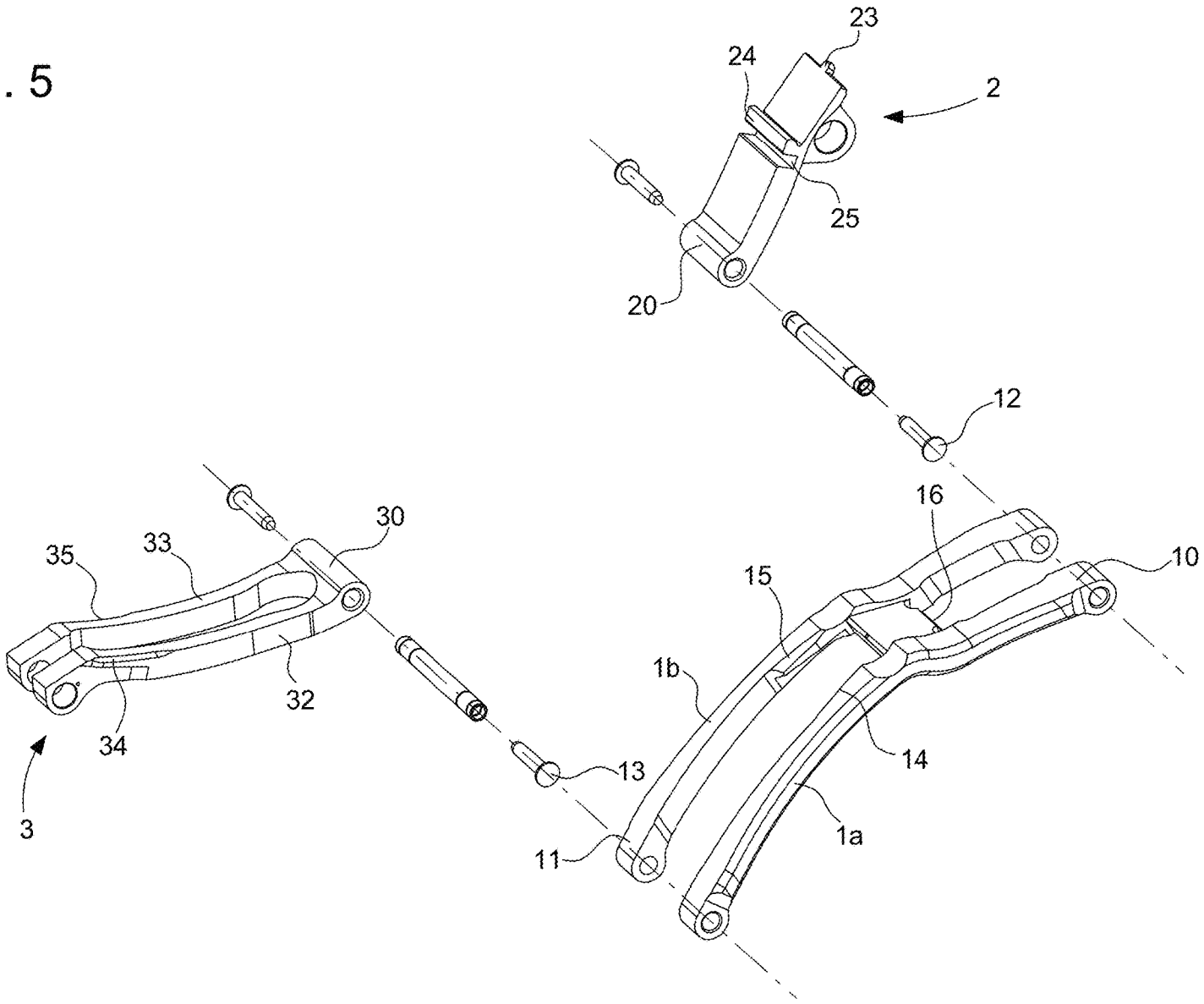
FIG. 5 is an exploded view of the clasp according to the invention.

FIGS. 1 and 4 are perspective views of the bracelet clasp which comprises a first rigid strip 1 having two longitudinal members 1*a* and 1*b* connected together by a bridge 1*c*. A first end 10 of this strip is hinged at a first end 20 of a second folding strip 2 via a shaft 12. This second strip 2 is configured to receive a first strand of the bracelet at the second end 21 thereof by means of a shaft 23.

The other end 11 of the first strip 1 is hinged at a first end 30 of a third folding strip 3, the third strip 3 partially covering the second end 21 of the second strip 2 when the clasp is in the closed position.

From the first end 30 of the third strip 3 emerge first and second arms 32 and 33 that are mobile in translation. According to an alternative embodiment of the invention, not shown in the figures, the first strip 1 can be provided solid and have a receptacle comprising locking means configured to receive the arms 32 and 33.

The clasp also comprises a cap 4, hinged at the arms 32 and 33, equipped with first and second flaps 40 and 41 extending perpendicularly with respect to the cap 4. The flaps 40 and 41 have holes 42 and 43 configured to receive the ends of push-pieces 320, 330 to create the hinge between the arms 32, 33 and the cap 4.

The cap 4 can have means for holding a second strand of the bracelet, such as a slug 44 as illustrated in the figures or a bar so as to define a starting point for the second strand of the bracelet. FIG. 4 illustrates the first and second push-pieces 320 and 330 which are connected to the first and second arms 32 and 33.

The locking mechanism is arranged to keep the third strip 3 on the first strip 1 when no pressure is exerted simultaneously on the push-pieces 320 and 330. To this end, the longitudinal members 1*a* and 1*b* of the first strip 1 respectively have fixed hooks 14 and 15 configured to cooperate respectively with hooks 34 and 35 disposed on the arms 32 and 33. This coupling can be observed in FIGS. 2 and 4.

According to the invention, the clasp comprises a banking 23 arranged to be housed or rest between the first and second arms 32, 33 of the third strip when the clasp is in the closed position, and more specifically between the ends of the first and second arms 32, 33 which receive the push-pieces 320, 330.

According to a first embodiment, the banking 23 is disposed at the second end 21 of the second strip 2, the banking 23 being positioned between the first and second arms 32, 33 of the third strip when the clasp is in the closed position.

According to a second embodiment, the banking 23 is disposed in the middle of the first strip 1 on the bridge 1*c* connecting the two longitudinal members 1*a* and 1*b*.

Figure 2:
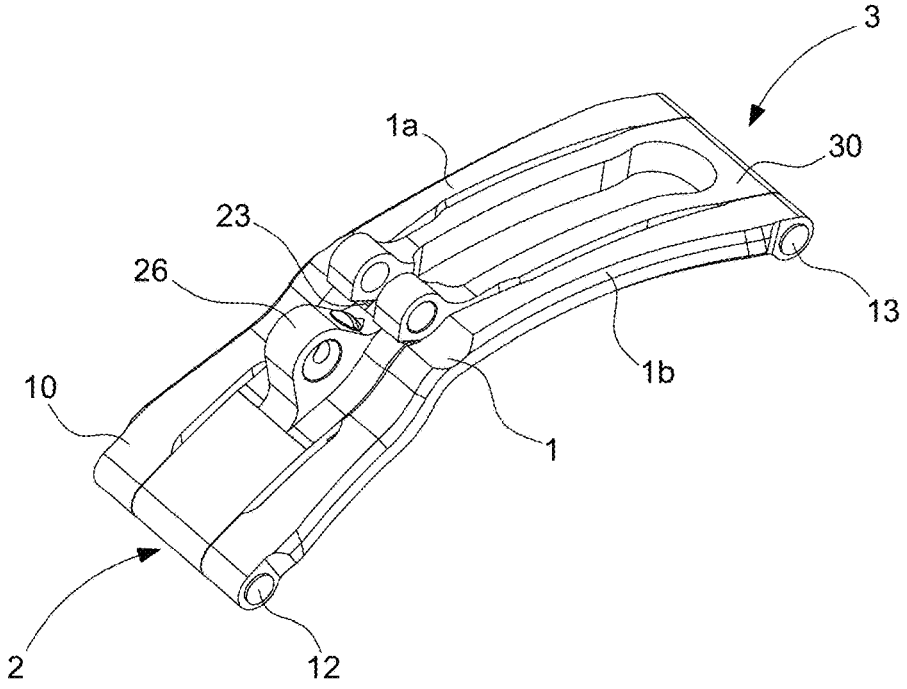
FIG. 2 is a top view of a clasp according to the invention, the clasp being in the closed position.
Figure 3:
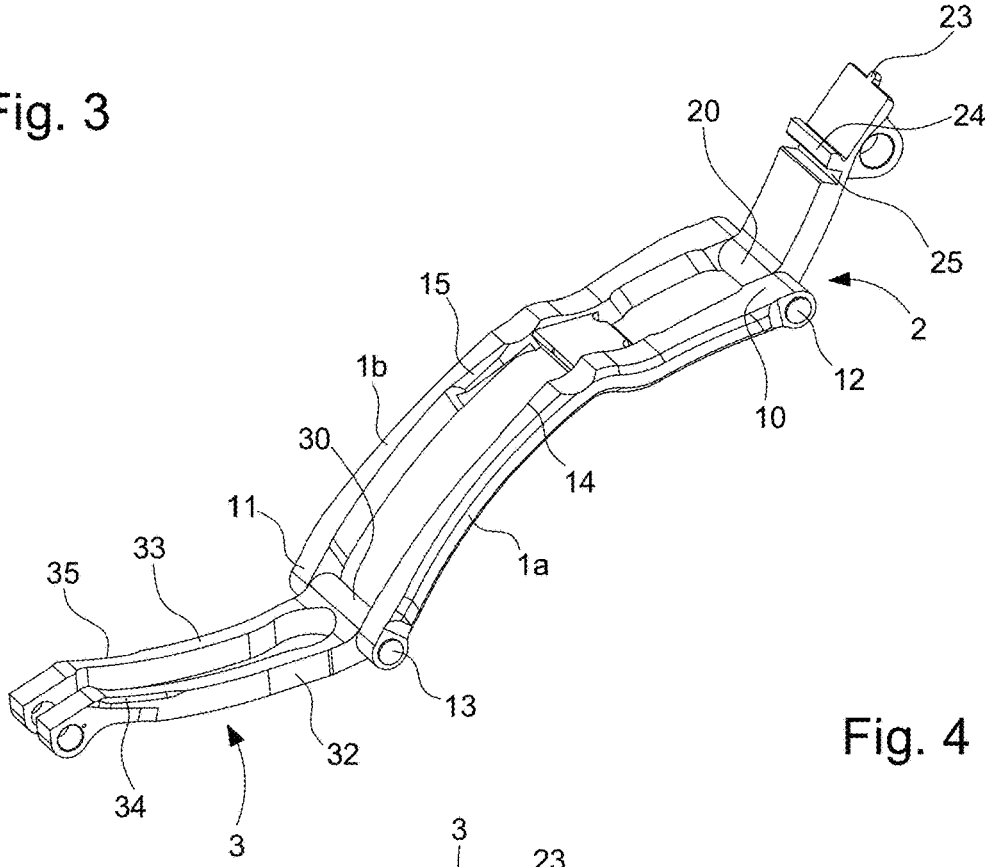
FIG. 3 is a bottom perspective view of a clasp according to the invention, the clasp being in the open position.

When the clasp is folded up or in the closed position as illustrated in FIGS. 2 and 4, each end of the arms 32, 33 receiving a push-piece 320, 330 comes into contact with the banking 23 when a pressure is exerted on the push-pieces 320, 330. The banking 23 thus makes it possible to limit the travel of the free ends of the arms 32 and 33, the distance between the end of the arms 32, 33 and the banking 23 defining the length of travel of the free ends of the arms 32 and 33. In this way, it is possible to predetermine the necessary length of travel of the arms 32, 33 to obtain a symmetrical movement thereof and ensure the proper opening of the clasp.

When a pressure is exerted on the push-pieces 320 and 330, the clasp is unlocked by a symmetrical opening of the arms 32, 33, the banking 23 making it possible to limit the travel of each arm 32, 33 and therefore ensure the correct opening of the clasp.

It will be understood that if the banking 23 did not exist, a non-identical or similar pressure exerted on the push-pieces 320, 330 would not enable a correct movement of the arms to enable the correct opening of the clasp. For example, when the wearer exerts a greater pressure on the push-piece 320 than on the push-piece 330, the free end of the flexible arm 32 can come into contact against the other free end of the flexible arm 33 and prevent the correct opening of the clasp.

In conclusion, to open the clasp according to the present invention, the wearer merely exerts simultaneous pressures on the two pressures on the two push-pieces 320, 330 until the free end of the flexible arms 32, 33 comes into contact with the banking 23. The hooks 34 and 35 of the arms 32 and 33 are then released from the hooks 14 and 15 of the longitudinal members 1*a* and 1*b*, thus triggering the release of the third strips 3 and the opening of the clasp.

It goes without saying that the present invention is not limited to the example shown but that various alternatives and modifications that may be apparent to a person skilled in the art can be made thereto.

The invention claimed is:

1. A bracelet clasp comprising:

a first rigid strip of which a first end is hinged on a first end of a second folding strip configured to receive a first strand of a bracelet at a second end thereof, and of which a second end of the first rigid strip is hinged on a first end of a third folding strip from which first and second arms extend at which a cap is hinged equipped with first and second flaps extending perpendicularly with respect to the cap, and means for holding a second strand of the bracelet, the third folding strip partially covering the second end of the second folding strip when the bracelet clasp is in a closed position, first and second push-pieces integral with the first and second arms, a locking mechanism configured to keep the third folding strip locked on the first rigid strip when no pressure is exerted simultaneously on the first and second push-pieces, and a banking rigidly connected to the second end of the second folding strip, the banking being housed between the first and second arms of the third folding strip in the closed position of the bracelet clasp, to ensure a symmetrical opening of the first and second arms when simultaneous pressures are exerted on the first and second push-pieces.

2. The bracelet clasp according to claim 1, wherein the banking has a width which defines a length of travel of the push-pieces.

3. The bracelet clasp according to claim 1, further comprising hooks to keep the second folding strip locked against the first rigid strip when the bracelet clasp is in the closed position.

4. The bracelet clasp according to claim 1, wherein the locking mechanism comprises a first pair of hooks rigidly connected to the first rigid strip, and a second pair of hooks rigidly connected to the third folding strip.

5. The bracelet clasp according to claim 4, wherein the second pair of hooks is rigidly connected to the first and second arms.

6. The bracelet clasp according to claim 1, wherein the first and second arms are laterally flexible on all or part of a length thereof.

7. A wristwatch including a bracelet equipped with the bracelet clasp according to claim 1.

8. A bracelet clasp comprising:

a first rigid strip of which a first end is hinged on a first end of a second folding strip configured to receive a first strand of a bracelet at a second end thereof, and of which a second end of the first rigid strip is hinged on a first end of a third folding strip from which first and second arms extend at which a cap is hinged equipped with first and second flaps extending perpendicularly with respect to the cap, and means for holding a second strand of the bracelet, the third folding strip partially covering the second end of the second folding strip when the bracelet clasp is in a closed position, first and second push-pieces integral with the first and second arms, a locking mechanism configured to keep the third folding strip locked on the first rigid strip when no pressure is exerted simultaneously on the first and second push-pieces, and a banking rigidly connected to the first rigid strip, the banking being housed between the first and second arms of the third folding strip in the closed position of the bracelet clasp, to ensure a symmetrical opening of the first and second arms when simultaneous pressures are exerted on the first and second push-pieces.

9. A bracelet clasp comprising:

a first rigid strip of which a first end is hinged on a first end of a second folding strip configured to receive a first strand of a bracelet at a second end thereof, and of which a second end of the first rigid strip is hinged on a first end of a third folding strip from which first and second arms extend at which a cap is hinged equipped with first and second flaps extending perpendicularly with respect to the cap, and means for holding a second strand of the bracelet, the third folding strip partially covering the second end of the second folding strip when the bracelet clasp is in a closed position, first and second push-pieces integral with the first and second arms, a locking mechanism configured to keep the third folding strip locked on the first rigid strip when no pressure is exerted simultaneously on the first and second push-pieces, and a banking rigidly connected to the cap, the banking being housed between the first and second arms of the third folding strip in the closed position of the bracelet clasp, to ensure a symmetrical opening of the first and second arms when simultaneous pressures are exerted on the first and second push-pieces.

* * * * *